US005206799A

United States Patent [19]

Tiesler

[11] Patent Number: 5,206,799

[45] Date of Patent: Apr. 27, 1993

[54] LAMP/REFLECTOR UNIT

[75] Inventor: Helmut Tiesler, Cologne, Fed. Rep. of Germany

[73] Assignee: U.S. Philips Corporation, New York, N.Y.

[21] Appl. No.: 790,937

[22] Filed: Nov. 12, 1991

[30] Foreign Application Priority Data

Nov. 22, 1990 [NL] Netherlands ..... 9002543

[51] Int. Cl.[5] ..... F21V 7/00

[52] U.S. Cl. ..... 362/296; 362/310; 362/369; 313/113; 313/318

[58] Field of Search ..... 313/113, 318; 362/310, 362/369, 390, 296

[56] References Cited

U.S. PATENT DOCUMENTS 5,053,935 10/1991 Hellwig et al. ..... 313/318 X

FOREIGN PATENT DOCUMENTS 8607330 6/1986 Fed. Rep. of Germany .

128754 7/1984 Japan .

OTHER PUBLICATIONS

Abstract of Japanese application 59-128754, Patent Abstracts of Japan, vol. 8, No. 256 (E-280), p. 40.

*Primary Examiner*—Stephen F. Husar

*Attorney, Agent, or Firm*—Robert J. Kraus

[57] ABSTRACT

The lamp/reflector unit comprises a metal reflector (1) within which an electric lamp (3) is secured. A lamp base (20) is mounted to the reflector (1) by means of an elastic synthetic resin (23), which may substantially fill up the lamp base (20). Current conductors (22) which may each be composed of several thinner conductors, may connect contacts (21) of the lamp base (20) to current supply conductors (7) emanating from the lamp (3). They may be made of copper and be secured to the current supply conductors (7) in a clamping manner. The unit suppresses acoustic resonance.

5 Claims, 1 Drawing Sheet

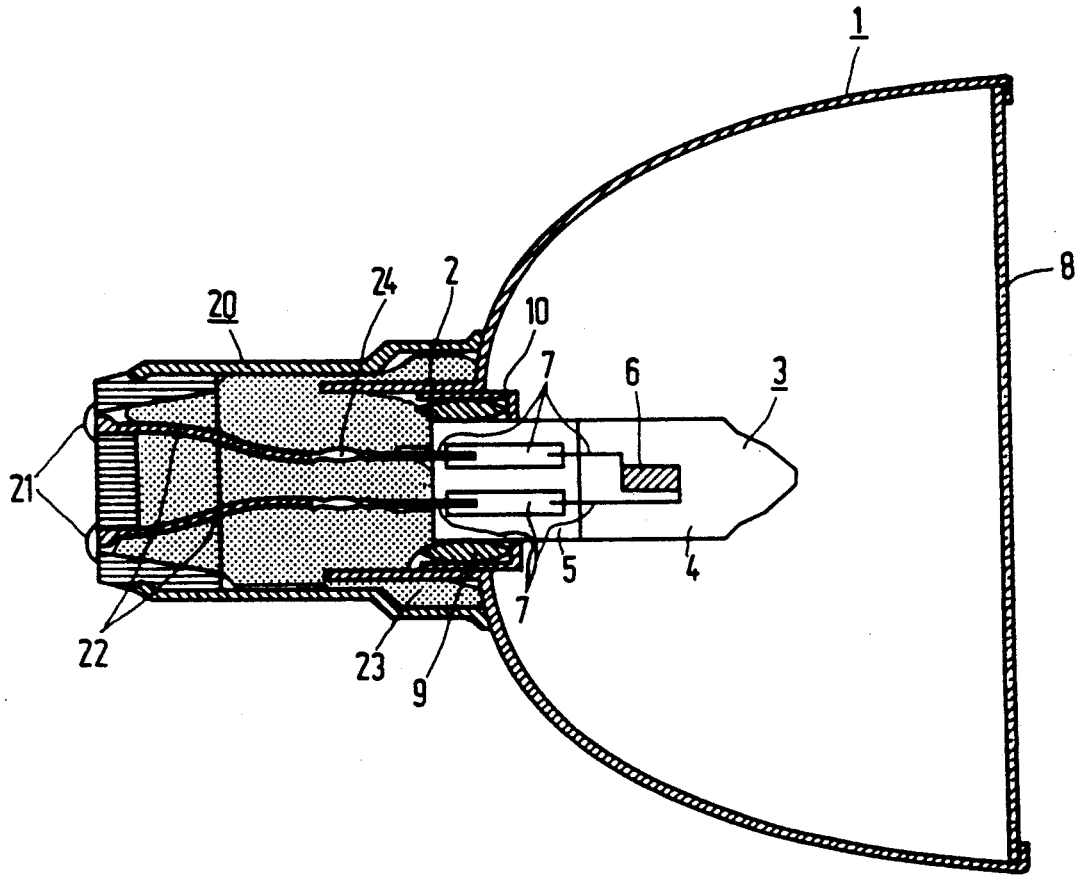
1
8
20
24
2
10
7
6
3
21
5
4
7
22
23
9

LAMP/REFLECTOR UNIT

The invention relates to a lamp/reflector unit comprising

- a concave metal reflector provided with a neck-shaped portion;
- an electric lamp provided with a lamp vessel having a seal which is fixed in the neck-shaped portion, an electric element in the lamp vessel, and current supply conductors extending from the electric element through the seal to the exterior;
- a lamp base provided with contacts, which is fastened to the neck-shaped portion of the reflector;
- current conductors fastened to respective current supply conductors and to respective contacts.

Such a lamp/reflector unit is commercially available. The known unit is used for creating accent illumination, possibly supplied via a dimmer.

In this unit, the lamp base is fastened to the neck-shaped portion with an inorganic adhesive, such as, for example, the lamp cement with which the lamp vessel is fixed in the neck-shaped portion of the reflector.

It has been found that the known unit, especially when used in conjunction with a dimmer, can exhibit acoustic resonance, which can be unpleasant, particularly if several units are used in a room.

The invention has for its object to provide a lamp/reflector unit of the kind described in the opening paragraph which, among other characteristics, is of a simple construction and counteracts the occurrence of acoustic resonance.

According to the invention, this object is achieved in that the lamp base is fastened to the neck-shaped portion by means of an elastic synthetic resin.

A rigid mechanical coupling between the lamp base and the reflector is avoided with this measure and the transfer of vibrations is restricted. Vibrations in the lamp base may be generated, for example, by a dimmer through which the lamp is supplied. A rubbery synthetic material such as, for example, silicone rubber, was found to be very suitable.

It is favourable to connect the current supply conductors of the lamp to the contacts of the lamp base not by means of rigid wires or strips, but by means of current conductors which are each composed of several thinner conductors, such as, for example, a stranded or braided conductor, such as a litz wire. Such conductors have a low rigidity and thus transfer vibrations badly. In a favourable embodiment, the conductors are made of copper, so that electromagnetically induced vibrations in these conductors are avoided.

The lamp base may be substantially entirely filled with the elastic synthetic resin. The synthetic resin then prevents the conductors from coming into contact with one another when they are not or loosely tensioned.

It has been found favourable to connect the conductors to the current supply conductors by means of a clamped joint. This may be realised, for example, in that a metal bush is clamped individually around a current conductor and around a current supply conductor through deformation, or in that such a bush is clamped around a current conductor and a current supply conductor jointly.

An embodiment of the lamp/reflector unit according to the invention is shown in the drawing in longitudinal section.

The lamp/reflector unit has a concave metal, for example aluminum, reflector 1 with a neck-shaped portion 2.

An electric lamp 3 has a lamp vessel 4 of glass, for example quartz glass, with a seal 5 which is fixed in the neck-shaped portion 2. An incandescent body 6 is present as the electric element in the lamp vessel, connected to current supply conductors 7 which issue to the exterior from the seal 5.

A lamp base 20 provided with contacts 21 is fastened to the neck-shaped portion 2 of the reflector 1.

Current conductors 22 are fastened to respective current supply conductors 7 and respective contacts 21.

The lamp base 20 is fastened to the neck-shaped portion 2 with an elastic synthetic resin 23.

The current conductors 22 are each composed of several thinner conductors and, in the drawing, are copper litz wires which have an excess length.

The elastic synthetic resin 23 fills up the lamp base 20 substantially completely.

The current conductors 22 are connected to the current supply conductors 7 by means of a clamped connection 24 in that each time a metal bush is separately clamped on a current conductor 22 and on a current supply conductor 7 through deformation, i.e. flattening.

In the drawing, the reflector 1 is closed off by a glass disc 8. The electric lamp 3 has a gas filling of hydrogen bromide, for a halogen cycle, and rare gas.

The seal 5 of the lamp vessel 4 is fixed in the neck-shaped portion 2 with lamp cement 9. A metal bush 10 in said portion prevents the cement 9 running into the reflector before it has been cured.

The lamp shown effectively suppresses acoustic resonances.

I claim:

1. A lamp/reflector unit comprising

- a concave metal reflector (1) provided with a neck-shaped portion (2);
- an electric lamp (3) provided with a lamp vessel (4) having a seal (5) which is fixed in the neck-shaped portion (2), an electric element (6) in the lamp vessel, and current supply conductors (7) extending from the electric element through the seal to the exterior;
- a lamp base (20) provided with contacts (21), which is fastened to the neck-shaped portion (2) of the reflector (1);
- current conductors (22) fastened to respective current supply conductors (7) and to respective contacts (21), characterized in that the lamp base (20) is fastened to the neck-shaped portion (2) by means of an elastic synthetic resin (23).

2. A lamp/reflector unit as claimed in claim 1, characterized in that the current conductors (22) are each composed of several, thinner conductors.

3. A lamp/reflector unit as claimed in claim 2, characterized in that copper current conductors (22) are used.

4. A lamp/reflector unit as claimed in claim 2 or 3, characterized in that the elastic synthetic resin (23) fills up the lamp base (20) substantially completely.

5. A lamp/reflector unit as claimed in claim 1 or 2, characterized in that the current conductors (22) are connected to the current supply conductors (7) by means of a clamped connection (24).

* * * * *